United States Patent [19]

Turbowitz et al.

[11] Patent Number: 4,540,376

[45] Date of Patent: Sep. 10, 1985

[54] AMPHIBIOUS TOY VEHICLE

[75] Inventors: Leslie Turbowitz, West Orange, N.J.; William Pipa, New Hyde Park, N.Y.

[73] Assignee: Azrack-Hamway International, Inc., New York, N.Y.

[21] Appl. No.: 594,349

[22] Filed: Mar. 28, 1984

[51] Int. Cl.[3] ..... A63H 23/04

[52] U.S. Cl. ..... 446/164; 446/443; 446/462

[58] Field of Search ..... 446/153, 163, 164, 165, 446/160, 457, 462, 463, 464, 443

[56] References Cited

U.S. PATENT DOCUMENTS

| | | | |
|---|---|---|---|
| 2,775,062 | 12/1956 | Gibson, Jr. et al. | 446/457 X |
| 2,862,332 | 12/1958 | Johnson | 46/213 |
| 3,046,697 | 7/1962 | Pullen | 46/243 |
| 3,307,290 | 6/1964 | Pedersen | 46/39 |
| 3,447,259 | 6/1969 | Cagen | 46/243 |
| 3,733,739 | 5/1973 | Terzian | 446/462 |
| 4,270,307 | 6/1981 | Arigaya | 46/254 |
| 4,443,968 | 4/1984 | Law | 446/462 |

*Primary Examiner*—Mickey Yu

*Attorney, Agent, or Firm*—Amster, Rothstein & Engelberg

[57] ABSTRACT

An amphibious toy vehicle powered by a water turbine and 4 drive wheels adapted to operate in a forward and backward direction on land and in a forward straight and circular direction in water. A single battery operated motor coupled to a transmission simultaneously drives both the 4 drive wheels and the water turbine. Power shafts from the transmission to the water turbine and the drive wheels are contained in isolated vertical risers extending above the water line so that the vehicle housing cavity containing the battery source, motor and transmission remain water-free without the use of seals.

5 Claims, 5 Drawing Figures

AMPHIBIOUS TOY VEHICLE

This invention generally relates to a toy vehicle adapted for use in water or on land.

While there have been many examples of toy vehicles for use on land or in water, there have not been many examples of toy vehicles adapted for use both on land and in water. One of the difficulties in manufacturing a vehicle of this type is to design a housing so that water will not seep in and destroy the drive components. This usually involves employing a watertight seal, such as that disclosed in U.S. Pat. No. 4,270,307. Watertight seals tend to increase the cost of toys which, in this very competitive market, place a toy incorporating such seals at a disadvantage. In addition, seals do not usually work very well, allowing water to leak into the toys, either submerging them or ruining their internal components. Operating a shaft through a seal requires increased power, which, in a toy powered by a small battery source, tends to rapidly decrease battery life, adding to the expense of the toy and the overall dissatisfaction of the user.

One attempt to overcome the use of seals in an amphibious toy vehicle can be seen in U.S. Pat. No. 2,826,332 where a watertight housing is used open-side up with paddle wheels for use in water. The paddle wheels are replaced by tires and the vehicle is operated open-side down for use on land. This vehicle has the disadvantage of requiring a change from tires to paddle wheels when one wishes to use the vehicle in water instead of on land.

It was to overcome these problems in the prior art that this invention was made. In particular, it is an object of the present invention to provide an amphibious toy vehicle with an isolated driveshaft and risers so that the vehicle does not require any seals to keep water out of the inside of the vehicle housing.

It is an overall objective of this invention to provide an amphibious vehicle which is inexpensive to produce, which functions well at low power requirements, which does not require the child playing with it to change parts to achieve the amphibious function and which is constructed to prevent water from entering the area of the vehicle drive mechanism.

It is a more general object of the invention to provide a toy vehicle with 4-drive wheels and a water turbine both powered by a single battery-operated motor so that the vehicle can travel both on land and in water without requiring any accessory changes.

It is a further and more specific object of the present invention to provide a water turbine in combination with a 4-wheel drive vehicle rather than a propeller drive to power the vehicle in water to both prevent child injury from a spinning propeller and increase the integrity of the toy since propeller drives are historically fragile.

In accordance with the invention, the amphibious toy vehicle comprises a buoyant housing with a liquid propulsion means and driving wheels coupled to the housing which are simultaneously driven by a motor through a transmission. The shafts driving the wheels and the turbine are enclosed in chambers isolated from the housing cavity and vertically rising above the water level of the vehicle so that no seals are necessary to keep water out of the housing cavity where the motor and transmission are installed.

In a particular embodiment of the invention, the liquid propulsion means is a turbine, similar to that shown in U.S. Pat. No. 3,046,697 and U.S. Pat. No. 3,447,259, the chamber of which is integrally formed with the buoyant housing. Those skilled in the art will appreciate that the liquid propulsion means can be of any type, including, but not limited to, a propeller drive, a jet drive and a paddle drive. The motor is of a small electric type powered by a battery source located in the cavity of the buoyant housing. The transmission mechanism includes driving, intermediate and driven gears coupling the motor to the turbine and driving wheels. The turbine is driven at approximately 42% of the speed of the motor, while the wheels are driven at less than 4% of the speed of the motor.

The driveshaft for the wheels is located in a horizontal hollow chamber which is interconnected to two vertical risers housing the two power shafts connected to the driveshaft and the turbine. The vertical risers extend above the vehicle water level when the vehicle is operating in water. Water is allowed to enter the driveshaft chamber and the vertical risers through the openings in the buoyant housing for the four axles and the turbine. However, water does not rise above the water level of the vehicle and therefore does not rise above the top of the vertical risers, thereby maintaining the cavity of the buoyant housing water-free.

The vehicle is equipped with four soft plastic tires formed with a serrated tread to aid in traction on the ground and forward movement in the water. The polarity of the motor is controlled by a power switch and, in addition to a forward position, can be reversed to operate the vehicle in reverse on land or in a forward circular clockwise motion in water.

These and other objects of the invention will become more apparent to a worker skilled in the art upon reading the following detailed description taken in conjunction with the drawings, of which:

Figure 1:
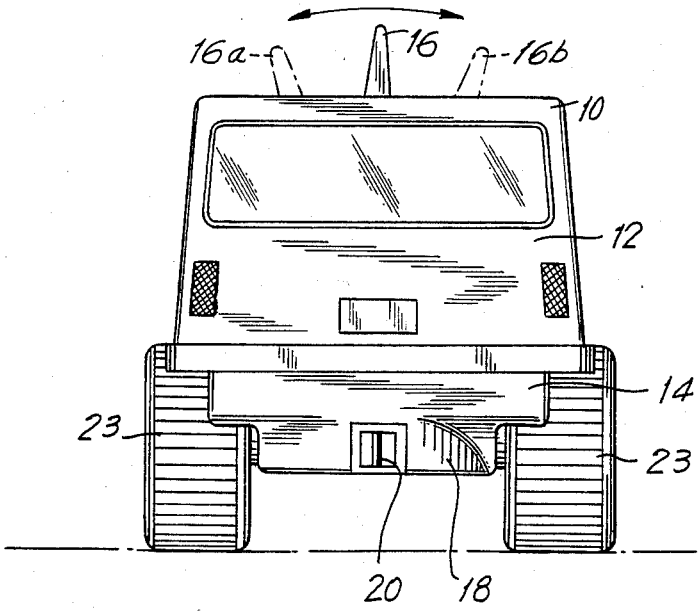
FIG. 1 is a rear view of the toy vehicle.

Referring to FIG. 1, amphibious toy vehicle 10 includes a body 12 formed, for example, of molded plastic or other suitable material adapted to fit on housing 14 with a slip fit. Body 12 is equipped with a slot 13 (see FIG. 3) in its roof section to allow power switch 16 to be accessed for switching the vehicle on in a forward or reverse direction. Housing 14 is formed out of plastic or another suitable material and is integrally formed with turbine chamber 18 and turbine outlet port 20. Two serrated front wheels 22 and two serrated rear wheels 23 are drivingly connected to housing 14 as will later be discussed in more detail.

Figure 2:
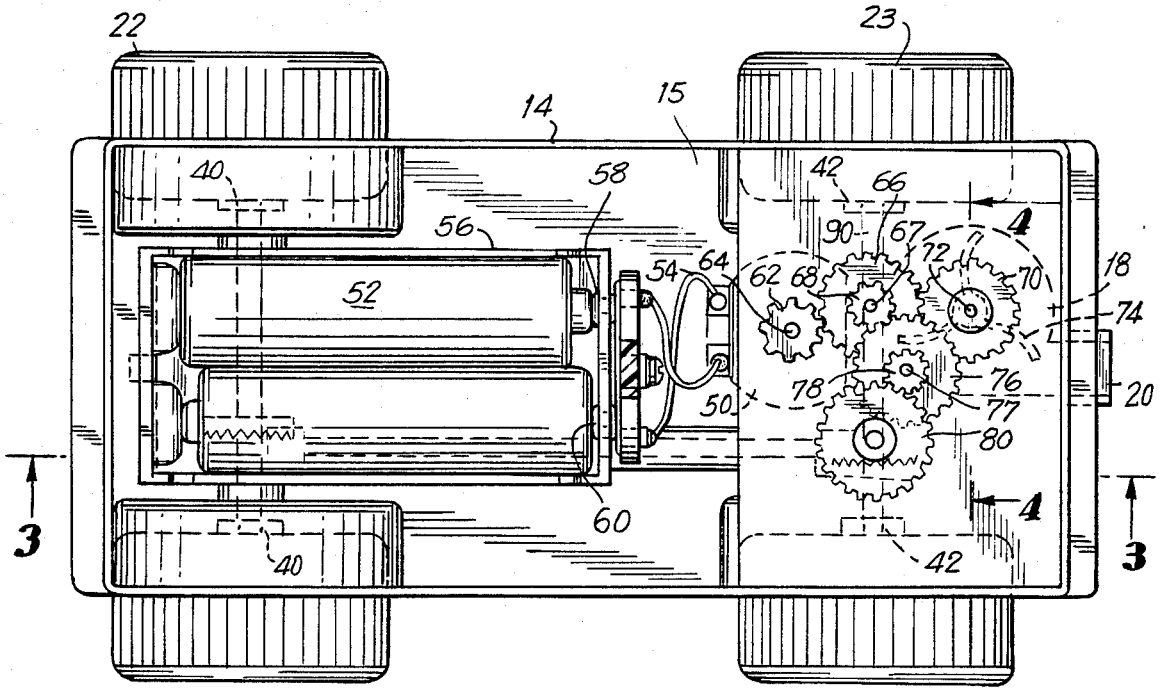
FIG. 2 is a top view of the toy vehicle with the body removed and portions shown in phantom.
Figure 3:
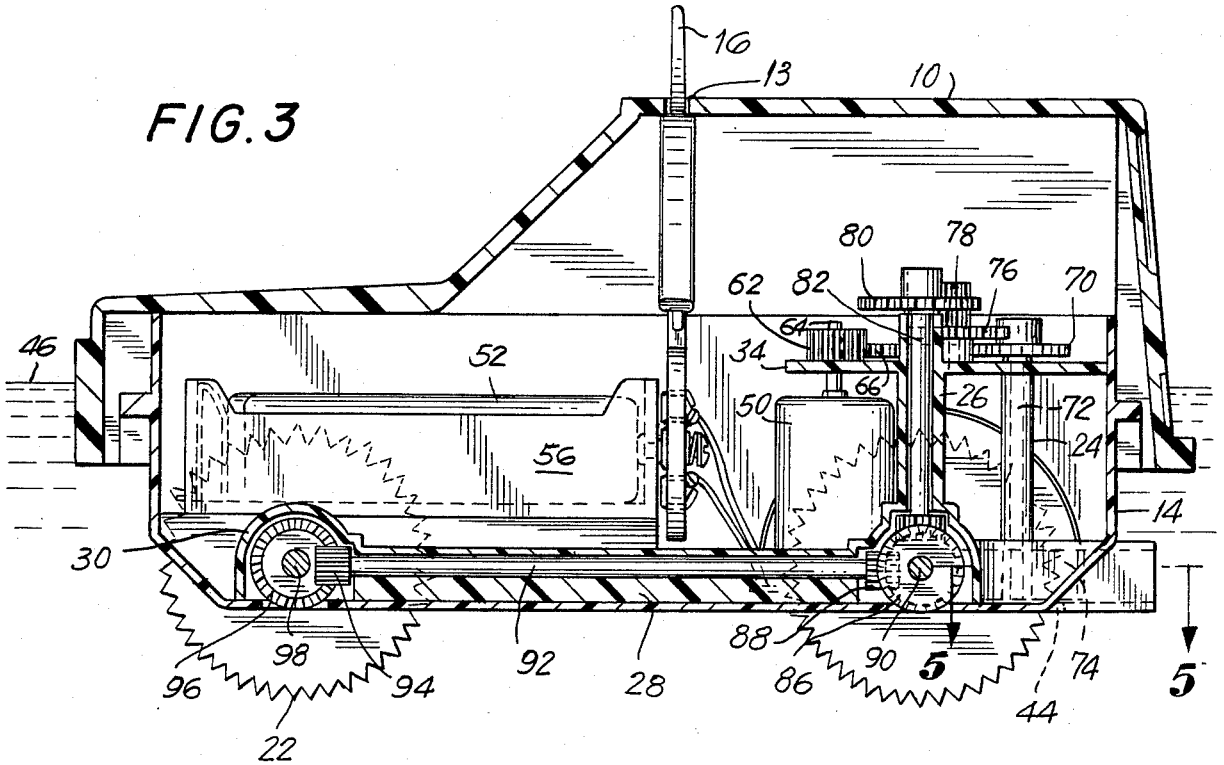
FIG. 3 is a side sectional view taken along line 3—3 of FIG. 2 looking at a cut-away of the vehicle.
Figure 4:
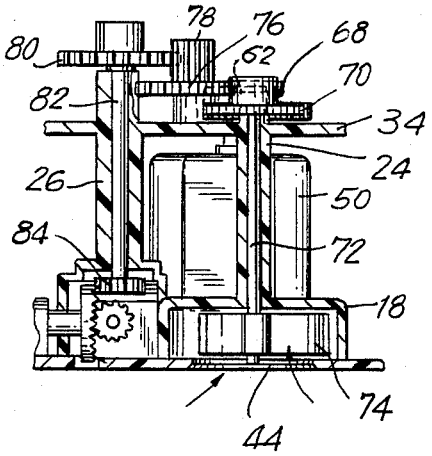
FIG. 4 is a rear sectional view taken along line 4—4 of FIG. 2 showing the motor, transmission, vertical risers and the water turbine.

Referring now to FIGS. 2 and 3, housing 14 is also formed with turbine shaft vertical riser 24, power shaft vertical riser 26, drive shaft chamber 28, front gear housing 30 and rear gear housing 32. Turbine shaft vertical riser 24 is connected on the bottom end to turbine chamber 18 while the other end is partially sealed by transmission plate 34. Power shaft vertical riser 26 is connected on the bottom to rear gear housing 32 and transmission plate 34 on the top. Drive shaft chamber 28 is a hollow chamber connected to front gear housing 30 and a rear gear housing 32.

Turbine shaft vertical riser 24, power shaft vertical riser 26, drive shaft chamber 28, front gear housing 30 and rear gear housing 32 are all isolated from the inside cavity 15 of housing 14 so that water will not enter inside cavity 15 when the vehicle is operating in water. As will be appreciated, this is accomplished without the use of seals.

Front axle 36 and rear axle 38 protrude through housing 14 at holes 40 and 42 respectively. Water enters turbine chamber 18 through inlet port 44. When the amphibious toy vehicle 10 is operating in water, the vehicle floats at a water level 46. Because of the absence of any seals, when the vehicle is operating in water, water enters front gear housing 30 and rear gear housing 32 through holes 40 and 42 in housing 14 and enters turbine chamber 18 through turbine inlet port 44. Water rises in vertical risers 24 and 26 to water level 46, which is lower than transmission plate 34 and the water is thus isolated in risers 24 and 26, turbine chamber 18, front geat housing 30, rear gear housing 32 and drive shaft chamber 28 so that the inside cavity 15 of housing 14 is maintained water-free.

Referring to FIGS. 2 through 5, motor 50 is powered by battery source 52, through wires 54. The battery source, in this case two AA standard batteries, 52 is held by battery holder 56. When battery source 52 is installed so that the positive side of battery source 52 is connected to terminal 58 and the negative side of battery source 52 is connected to terminal 60, positioning switch 16 to position **16*a* will drive the motor in a counter-clockwise direction so that amphibious toy vehicle 10 travels forward in water and on land. Conversely, positioning switch 16 to position 16*b* will drive amphibious toy vehicle 10 in reverse on land and in a forward circular clockwise direction when vehicle 10** is operating in water.

Drive pinion 62 is installed on shaft 64 of motor 50. When motor 50 is activated, drive pinion 62 drives intermediate gear 66 which is concentrically mounted on shaft 67 with pinion 68. Intermediate gear 66 drives turbine gear 70 which is attached to turbine drive shaft 72. Turbine drive shaft 72 is connected to and drives turbine 74. Pinion 68 drives intermediate gear 76 which is concentrically mounted on shaft 77 with pinion 78. Pinion 78, in turn, drives power shaft gear 80 which is connected to and drives power shaft 82. Power shaft 82 is connected to and drives crown gear 84 which drives rear final drive gear 86 which in turn powers rear drive shaft gear 88. Rear final drive gear 86 is concentrically mounted on rear axle 90 with rear wheels 23 and drives rear wheels 23 at a speed substantially equal to that of front wheels 22.

Rear drive shaft gear 88 is mounted on drive shaft 92, turning drive shaft 92 and forwardly mounted front drive shaft gear 94. Front drive shaft gear 94, in turn, drives front final drive gear 96, and front wheels 22 which are concentrically mounted on front axle 98 with front final drive gear 96.

Upon activation of motor 50, front wheels 22 and rear wheels 23 are driven at less than 4% of the speed of motor 50 while turbine blade 74 is driven at about 42% of the speed of motor 50.

Figure 5:
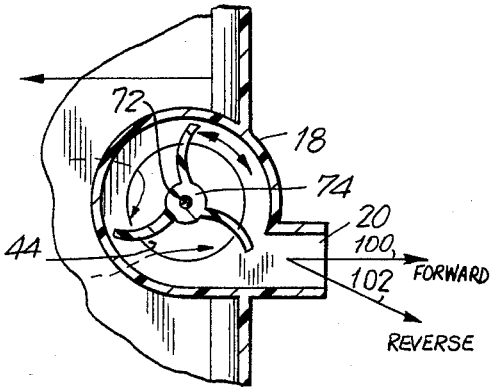
FIG. 5 is a sectional view taken along line 5—5 of FIG. 3 showing the top cut-away view of the water turbine.

Referring to FIGS. 1, 3 and 5, when toy vehicle 10 is operating in water and turbine 74 is driven in a counter-clockwise direction, water output from turbine outlet port 20 is pushed in direction 100 causing toy vehicle 10 to be propelled in a forward direction. When turbine 74 is driven in a clockwise direction, water output from turbine outlet port 20 is pushed in direction 102 causing toy vehicle 10 to be propelled in a forward circular clockwise direction.

Front wheels 22 and rear wheels 23 are serrated and formed from a soft plastic material to aid in the traction of toy vehicle 10 on land and to aid in the forward propulsion of toy vehicle 10 in water.

While what has been described is the presently preferred embodiment of the invention, it will be apparent to those skilled in the art that modifications and changes can be made to the invention while keeping within the spirit and scope thereof which is set forth in the appended claims.

I claim:

1. A toy vehicle buoyant in water having a buoyant housing which is formed with an internal cavity, the level at which said vehicle floats in water defining a vehicle water line, a drive chamber formed in said housing which is isolated from said vehicle internal cavity and which is open to the exterior of said housing below said vehicle water line, said housing having no other openings below the vehicle water line, said drive chamber having at least one vertical riser extending above said vehicle water line to prevent water from flowing from said drive chamber into said internal cavity, a power shaft disposed within said vertical riser and extending above the uppermost portion of said vertical riser, water propulsion means drivingly connected to said power shaft at a point below said vehicle water line, transmission means drivingly connected to said power shaft above said vertical riser, electric motor means drivingly engaged with said transmission means, power source means electrically connected to said electric motor means, at least one of said electric motor means and said power source means positioned in said internal cavity below said vehicle water line and power switch means adapted to connect said power source means to said electric motor means so that said electric motor means will operate and correspondingly drive said water propulsion means.

2. A toy vehicle as claimed in claim 1, wherein said electric motor means and said power source are both positioned below said vehicle water line.

3. A toy vehicle as claimed in claim 1, wherein said water propulsion means comprises a turbine chamber integrally formed with said buoyant housing and a water turbine drivingly connected to said power shaft and disposed within said turbine chamber.

4. An amphibious toy vehicle buoyant in water having a bouyant housing which is formed with an internal cavity, the level at which said vehicle floats in water defining a vehicle water line, at least one pair of drive wheels mounted for rotation on said buoyant housing, a drive chamber formed in said housing which is located from said internal cavity and which is open to the exterior of said housing below said vehicle water line, said housing having no other openings below said vehicle water line, said drive chamber formed with a first vertical riser and a second vertical riser which extend above said vehicle water line to prevent water from flowing from said drive chamber into said internal cavity, a first power shaft disposed within said first vertical riser and extending above the uppermost portion of said first vertical riser, water propulsion means drivingly engaged to said first power shaft at a point below said vehicle water line, said water propulsion means comprising a turbine chamber integrally formed with said vehicle housing and a turbine disposed within said turbine chamber, a second power shaft disposed within said second vertical riser and extending above said second vertical riser, said pair of drive wheels drivingly connected to said second power shaft at a point below said vehicle water line, transmission means drivingly connected to said first and second power shaft at a point above said vehicle water line, electric motor means drivingly engaged with said transmission means, power source means electrically connected to said electric motor means, at least one of said electric motor means and said power source means positioned below said vehicle water line, and power switch means adapted to connect said power source means to said electric motor means so that said electric motor means will operate in a clockwise direction and a counterclockwise direction causing said amphibious toy vehicle to operate in forward and rearward directions on land and in forward and forward circuitous directions in water.

5. An amphibious toy vehicle as claimed in claim 4 wherein, said electric motor means and said power source means are positioned below said vehicle water line.

* * * * *